United States Patent [19]

Kvam

[11] 4,017,097

[45] Apr. 12, 1977

[54] SKI BINDINGS

[76] Inventor: Ole Jacob Kvam, Waldemar Thranes gate 84B, Oslo 1, Norway

[22] Filed: Feb. 17, 1976

[21] Appl. No.: 658,838

[52] U.S. Cl. ..... 280/615; 280/11.37 E

[51] Int. Cl.[2] ..... A63C 9/20

[58] Field of Search ..... 280/615, 614, 631, 635, 280/623, 611, 11.37 E

[56] References Cited

UNITED STATES PATENTS

| | | | |
|---|---|---|---|
| 2,643,888 | 6/1953 | Hargis, Jr. | 280/635 |
| 2,675,244 | 4/1954 | Blanchard | 280/631 |
| 3,823,953 | 7/1974 | With | 280/615 |
| 3,850,439 | 11/1974 | Guttulsrud | 280/615 |
| 3,907,319 | 9/1975 | Berlied, Jr. | 280/615 |

FOREIGN PATENTS OR APPLICATIONS

| | | | |
|---|---|---|---|
| 125,454 | 6/1931 | Germany | 280/615 |
| 64,695 | 10/1940 | Norway | 280/615 |
| 161,590 | 7/1933 | Switzerland | 280/615 |

*Primary Examiner*—Robert R. Song
*Assistant Examiner*—David M. Mitchell

[57] ABSTRACT

Ski binding having a bottom member for mounting on a ski and receiving a sole of a ski shoe, and a guard element of essentially shoe toe shape mounted on upwardly projecting ears of the bottom member to pivot between upward inactive and downward active positions. The guard element has a lateral side from opposite ends of which longitudinal sides thereof converge. The lateral side faces the pivotal axis of the guard element and its under edge is designed in the upward position to permit insertion of the sole of the shoe on the bottom member and in the downward position to clamp the edge of the sole against the bottom member. The binding is also retainingly engageable on the sole via the bottom member and/or the under edge of the lateral side of the guard element. In the active position the guard element is adapted to cover the front edge of the sole of the shoe while a portion of the bottom element lying in front of this edge is adapted to engage the adjacent guard element.

9 Claims, 7 Drawing Figures

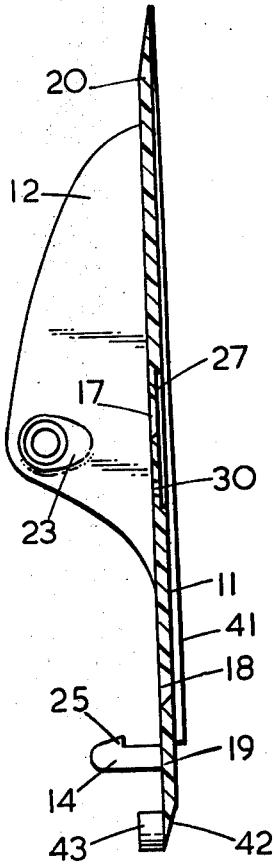
-FIG.1-
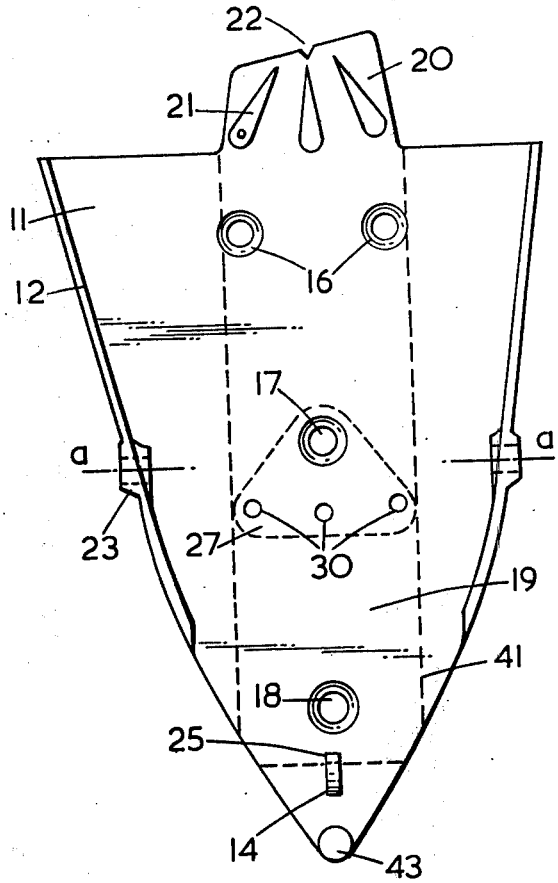
-FIG.2-
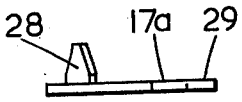
-FIG. 7-

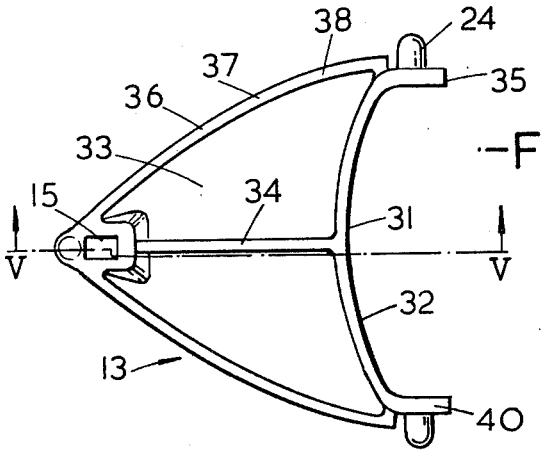
-FIG. 4-
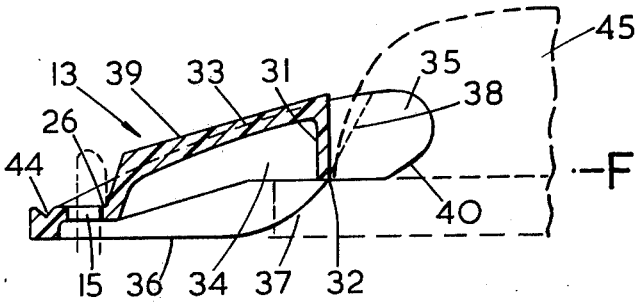
-FIG. 5-
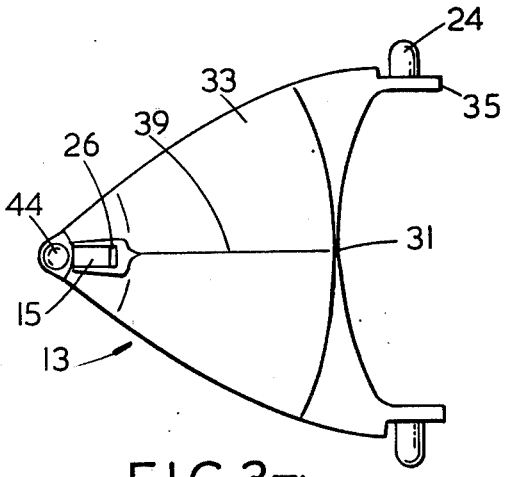
-FIG. 3-
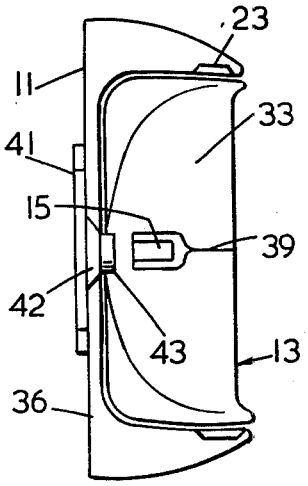
-FIG. 6-

SKI BINDINGS

BACKGROUND OF INVENTION

1. Field of Invention

This invention relates to ski bindings.

2. Description of the Prior Art

Most ski bindings are provided with clamp means of wire material. Such clamp means will, however, gradually deform the edge of the sole of the shoe and give rise to the risk of sole splitting. Besides an uneven distribution of pressure along the dissimilar portions of the clamp means and a reduction of the clamping effect, this involves something which results in a looser fitting of the shoe and a greater strain on gripping means cooperating with the sole.

Ski bindings are also known which have clamp means formed from sheet material having a pressure surface with a greater area than in the case of wire-formed clamp means. However, such bindings have been burdened with various other disadvantages which has meant that they have been little utilised. It has been difficult to avoid inconvenient ice formation on the clamp means under certain travelling conditions and the design of the lock mechanism, that is to say of the cooperating parts of the clamp means and the fastening means for the latter, has presented constructional problems.

SUMMARY OF THE INVENTION

It is an object of the invention to provide a ski binding which provides for a reliable gripping of the shoe after a long period of use and where troublesome ice formation is kept at a minimum. The locking mechanism must be designed so that it is not actuated by possible snow or ice deposits and it must be easy to operate, i.e. to open and close under all conditions of use.

Under certain travelling conditions the snow collects under the ski. The removal of this has, hitherto, presented problems because it has been necessary to remove the skis or to fit scrapers on the skis.

It is a further object of the invention to produce a ski binding which can be readily employed for scraping off snow from one's own or other skis.

According to the present invention a ski binding comprises a bottom member for mounting on a ski and for receiving a sole of a ski shoe, said member having ears adapted to project upwardly on either side of the toe of said shoe, a guard element having a continuous surface shaped essentially as a shoe toe and pivotably mounted on said ears to permit pivotal movement between upward inactive and downward active positions about an axis passing through said ears, said element having a lateral side and longitudinal sides converging forwardly from opposite ends of said lateral side, said lateral side facing said pivotal axis of said element and defining at its under edge clamp means designed in said upward position to permit insertion of said sole of said shoe on the bottom member on said bottom member of said sole of said shoe at its toe and in said downward position to hold the edge of said shoe sole down against said bottom member with said longitudinal sides of said guard element reaching down adjacent said bottom member, means associated with at least one of said bottom member and said clamp means for retainingly engaging said sole, and said guard element when in said active position being adapted to cover the front edge of the sole of the shoe and a portion of said bottom element which is to lie in front of said front edge, said portion locating in a fixed position thereon fastening means adapted to engage a retaining portion of said guard element adjacent thereto.

Such a ski binding provides a series of advantages. The surface pressure between the clamp means and the edge of the shoe sole can be lowered substantially without reducing the gripping ability. In this way, the shoe sole can maintain its shape unchanged even after a very extended period of use so that the gripping ability remains largely unaltered. The shape of the guard element causes the snow to be pushed away or at the least is prevented from being collected up. Likewise, there is little risk of ice formation under conditions which otherwise bring this about. The special shape of the guard element makes it possible to design the locking mechanism for easy operation which can be effected with the point of a ski stick without special extensive constructional measures being necessary. Moreover, it is possible to design the guard element so that it can serve as a scraper for scraping off snow from other skis.

BRIEF DESCRIPTION OF THE DRAWINGS

In order that the invention can be more clearly understood a preferred embodiment thereof will now be described, by way of example, with reference to the accompanying drawings in which:

FIG. 1 is a sectional side view of a bottom member having a catch for the right portion of a ski binding, FIG. 2 is a plan from above of the bottom member of FIG. 1, FIG. 3 is a plan from the upper side of a guard element, FIG. 4 is a plan from the lower side of the guard element of FIG. 3, FIG. 5 is a section on the line V — V of FIG. 4, FIG. 6 is a front view of the ski binding with the guard element swung downwards, and FIG. 7 is a side view of a spike plate for use in the bottom member of FIGS. 1 and 2.

The ski bindings according to the invention consist of a right and a left portion which are designed for fastening to right and left boots respectively so as to form right and left skis. Since the two binding portions are in principle the same, only the binding portion which is shown in the drawings, viz. the right, is described below.

Referring to FIGS. 1 to 6, each portion of the ski binding comprises two main parts, viz. a bottom member 11 having upwardly projecting ears 12 at the sides and a guard element or clamp shield 13 which is mounted in the ears so that it pivots a certain angle about an axis a — a which extends transversely of the ski approximately parallel to the bottom member. The bottom member 11 supports at its front edge an upwardly projecting lock or catch lever 14 which is adapted to cooperate with a corresponding opening 15 at the front edge of the guard element 13. The bottom member 11 can be made of metal, for example, aluminium, by punching. However, it is particularly appropriate to make it, as well as the guard element 13, of plastics material, preferably of polycarbonate or polyamide.

The bottom member 11 has, in general, a shape which corresponds in side profile to the front edge of a shoe sole, the ears 12 projecting upwards on each of its sides and forming a mutual angle which is similar to the tapering angle of the shoe sole. The bottom member 11 in the example is provided with four mounting holes for screws, of which two holes 16 are disposed at the side of each other approximately centrally below the main portion of the shoe sole, while the third hole 17 is located approximately centrally between the mounting points for the guard element 13 and the fourth hole 18 is located in front of the third on a portion 19 of the bottom member which projects forwards in front of the ears 12. The holes 16 – 18 are adapted in an appropriate manner for use by screws. In cases where the binding is to be mounted by adhering, the holes 16 – 18 are omitted. On moulding the bottom member 11 of plastics material, this can be readily done by leaving out the corresponding mould portions. Securing the binding by adhering can become particularly relevant for future skis which lack a core which provides a grip for the screws and which, at the same time, can have a top structure and a material which is better suited to adhering than current conventional skis. With bindings which are to be fixed by adhering, pins or lugs can be present on the under side of the bottom member 11 which can be brought into engagement with corresponding recesses in the upper surface of the ski. Such pins will provide extra strength and reliability under kick-off and other thrust-type strains which act in a horizontal plane.

Behind the ears 12, the bottom member 11 is extended in the bottom plane with a downwardly extending oblique plane 20 having approximately the breadth of the ski. The edge of the oblique plane extends slopingly in a direction transversely of the ski. At the transition between the strip 20 and the central portion of the bottom member 11 behind the holes 16, there extend low ribs 21 which converge rearwardly. The object of the ribs 21 is to prevent wedging of snow or ice between the sole of the shoe and the bottom member 11.

Centrally in the rear edge of the oblique plane 20, there is located a notch 22 which exhibits the central line for mounting of the bottom member.

The ears 12 are provided with respective thickenings 23 which lie on the axis a — a and are provided with a hole in the axial direction. The hole in a thickening 23 is designed for the reception of corresponding pins 24 in the guard element 13 (FIGS. 3, 4 and 6). Further details of the design of the ears are described below.

At the front part 19 of the bottom member 11, the catch lever 14 projects upwards as shown in FIG. 1. This catch lever can be designed integrally with the bottom member 11 or installed in a hole of the latter. In the latter case, the catch lever can be made from a material other than that of the bottom member, for example, of metal when the bottom member is of plastics material. The catch lever 14 is provided with a rearwardly directed projection 25 which can cooperate with a corresponding edge 26 on the guard element 13. The catch lever 14 is flexible a short distance forwards from its rest position and returns back to this position when the outer force load is taken away. This can be achieved due to the presence on the under side of a ramp-shaped rib 41 which extends downwardly from the rear edge of the bottom element 11 and forwards to the catch lever 14 with a breadth which is approximately equal to the breadth of the ski. The height of the rib 41 can be approximately 3mm at the front edge. The foremost portion of the bottom element 11 will thereby project freely outwards and can be pressed elastically downwards so that the catch lever 14 is carried forwards. In order that the catch lever 14 can be carried sufficiently forwards, the front edge of the bottom member 11 is bevelled off on the under side as shown at 42. Above this bevelling, the bottom member 11 supports a lug 43 having a cavity or recess for a tip of a ski pole.

On the under side, the bottom member 11 has, in general, a triangular recess 27 having a depth which is approximately equal to half the thickness of the bottom member in this region. Within this cavity lies the hole 17 and in front of this a row of holes 30 for leading through gripping spikes 28.

Such ski bindings are normally provided with gripping spikes which project upwardly from the bottom member and which during use engage with corresponding recesses or blind holes, if desired with metal reinforcement, in the sole of the shoe. Referring to FIGS. 1, 2 and 7; three spikes 28 are arranged on a support or spike plate 29, both the spike plate and the spikes being made of metal or plastics material. The spike plate 29 is formed with a hole **17*a* and is adapted with regard to configuration and thickness to the recess 27 so that it can be fitted closely into the latter when the hole 17*a* coincides with hole 17 and the positioning of the gripping spikes 28 and the holes 30** corresponds to each other.

This design makes it readily possible for the producer to deliver bindings with different hole arrangements 30 in the bottom member 11 and correspondingly different spike dispositions on the spike plate 29. This can be necessary in order that the binding is able to be utilised for the various shoe types which are employed in different countries. The spike plate 29 with the gripping spikes 28 is preferably relatively permanently mounted in the recess 27 and thus only rarely displaceable by the user.

However, it can be desirable to deliver the binding with the spike plate unmounted. In consequence, the holes 30 in the bottom member 11 can be utilised as an indication and control for simple and accurate boring or burning of holes in the sole of the shoe. The recess 27 is adapted in this instance to the spike plate 29 so that the latter can be easily pressed into position and secured.

The production of the bottom member 11 for different spike systems can be brought about by making the casting mould which covers the region around the recess 27 replaceable.

The guard element 13 comprises primarily the coaxial pins 24 which are mounted in the holes in the thickenings 23, a curved wall or plate 31 which connects the pins 24 and which at the under edge forms a clamp surface 32 which is to bear against the edge of the sole of the shoe, together with a guard 33 which extends from the upper edge of the wall 31 and away from the pivotal axis a — a and surrounds the opening 15 and forms the edge 26 at the side of the opening 15 which lies closest to the pivotal axis a — a. Further details of the guard element 13 are described below.

The guard 33 is generally similar to a pointed shoe toe with an upwardly directed, pyramid-shaped recess 44 on the point. The object of the guard firstly is to serve as an interconnecting element for the portions of the guard element 13 which exert a main function, namely the pins 24, the clamp surface 32 and the opening 15 for the catch lever 14. It will further act as a protecting end for the shoe by diverting pressure and drifting snow. Besides it prevents effectively the collection and fastening of snow and ice to the binding and the shoe.

For bracing, the guard 33 is provided internally with a central rib 34 which lies in a radial plane to the pivotal axis a — a from the wall 31 and forward to the portions which surround the opening 15. At the inner portion relative to the pivotal axis, the edge of the rib 34 passes substantially parallel to a plane through the under edge of the guard 33. Approximately from the middle and forward to the opening 15, the edge of the rib 34 passes approximately radially to the pivotal axis a — a or parallel to the upper edge of the guard 33 formed by the boundary line between left and right sides of the guard.

The pins 24 project outwardly from their respective flaps 35 which pass mutually parallel backwards from sides of the guard 33. Under edge 36 of the guard 33 is led at the ends in an arc 37 and a rectilinear extension 38 forward to the flaps 35 and the ends of the wall 31.

The flaps 35 are rounded off at the free end since the transition between the straight under side and the rounding off is formed by a bevelling 40 which forms an angle of about 30° with the under side. The bevellings 40 have as a primary task to guide the front edge of the shoe sole into position in the binding since they swing the guard element sufficiently upwards so that the shoe sole can be led freely in below the clamp surface 32.

In order to simplify the insertion of the sole of the shoe in the binding and the removal of the binding, it is appropriate, in addition, to mount the guard element so that it is prestressed towards a position where it is swung 10° – 20° upwards from the closed position. The binding can also be provided with cooperating arrest means at one or both of the pins 24. These arrest means, which can have the form of corresponding lugs and recesses (not shown) on the two main portions of the binding, can hold the guard element 13 in the insertion position until the shoe is in position.

The edge 26 in the opening 15 is drawn a little below from the upper edge of the guard 33. The opening is, moreover, dimensioned so that it slips through the catch link 14 with a small clearance at the projection 25. The distance from the inner edge of the hole or the opening 15 to the axis *a — a* is equally large or a little larger than the distance from the stem of the catch lever 14 to the axis. This means that the catch lever 14, which can be bent somewhat elastically forwards, is prestressed towards a locking position as indicated in FIG. 5 and so that the guard element 13 on pivoting down over the end of the pin 14 leads the projection 25 into engagement with the edge 26.

On opening the binding, the catch lever 14 is pressed forwards, that is to say away from the axis *a — a*, and the guard element 13 is released and swung upwards by virtue of the prestressing force. The actuation of the catch pin 14 can be done directly by the hand or with the tip of a ski pole while the user is erect.

The limited clearance between the catch lever 14 and the sides of the opening 15 prevents the pin from being deformed out over the elasticity limit when the guard element is swung down.

The projection 25 on the catch lever 14 and the edge 26 of the opening 15 can be alternatively located to the side of the middle line of the binding. The opening movement of the catch lever 14 will then occur in a lateral direction relative to the ski.

The upper edge 39 of the guard 33, that is to say the dividing line between right and left guard portions, extends rectilinearly between the upper edge of the wall 31 and the opening 15 and serves as a scraper for removing "clogging" under the skis. Alternatively, the guard 33 can be provided with a sharp rib which extends along the upper edge for the same purpose.

The ears 12 of the bottom member mutually form an angle which corresponds to the tip of the sole of the ski shoe or boot. At the front edge, the ears 12 are curved so that they coincide with sides of the guard element 13. In a corresponding manner, the upwardly directed edges of the ears 12 are fitted to the curve 37 and the extension 38 of the under edge of the guard element 13 so that during use there is formed a uniform, closed transition.

The guard element 13 can be provided with a recess or cavity 44 for a tip of a ski pole. With this the binding can be done by pressing with the ski pole and without the user having to bend.

The upper edge of the ears 12 and the rear edge 38 of the guard element 13 are preferably adapted to each other so that they form abutments against each other when the guard shield is swung up in the open position, for example with the under edge at an angle of 60° – 90° or more relative to the bottom member 11. In this way, a stop is formed for upward swinging of the guard element 13.

Alternatively, the flaps 35 can be designed so that they thrust against the sole of the shoe when the guard element is swung up into a certain position. This stopping will, however, only function during use. Therefore, it will always be necessary to design the guard element 13 and the ears 12 with a view to stopping the swinging movement of the guard element 13.

In FIG. 5 there is illustrated in broken lines a shoe toe 45 with the front edge of the sole in a squeezed-in position below the clamp surface 32.

In addition to or instead of spikes 28 on spike plate 29, the sole of the shoe can be retainingly engaged by similar means associated with the clamp surface 32.

The afore-described embodiment can be modified, for example, by locating the pins 24 on the ears 12 and the corresponding holes in the guard element 13. The angle dimensions can also be varied.

Besides the protective effect which the binding has as regards the action of wind and snow, it will also be mechanically protecting. The rounded off, closed shape means that the user is less vulnerable to twigs and other hindrances which are bound to occur on ski trails, then is the case with convention bindings.

In addition to the advantages which are mentioned, there is the possibility of economic production and attractive shape. The attractive shape is a meaningful advantage since to some degree it can be an assumption for utilising the remaining advantages which the binding confers. A less attractive binding will thus risk not being accepted by the users, even if it could otherwise be advantageous.

It can be relevant on orthopedic grounds to increase the ascending angle of the rib 41 so that the shoe sole receives a somewhat upwardly pointing position in the direction of movement. The ascending angle can thus be in the region of 1° – 5°, preferably 2° – 3°.

I claim:

1. A ski binding which comprises a bottom member for mounting on a ski and for receiving a sole of a ski shoe, said member having ears adapted to project upwardly on either side of the toe of said shoe, a guard element having a continuous surface shaped essentially as a shoe toe and pivotably mounted on said ears to permit pivotal movement between upward inactive and downward active positions about an axis passing through said ears, said element having a lateral side and longitudinal sides converging forwardly from opposite ends of said lateral side, said lateral side facing said pivotal axis of said element and defining at its under edge clamp means designed in said upward position to permit insertion on said bottom member of said sole of said shoe at its toe and in said downward position to hold the edge of said shoe sole down against the bottom member with said longitudinal sides of said guard element reaching down adjacent said bottom member, means associated with at least one of said bottom member and said clamp means for retainingly engaging said sole, and said guard element when in said active position being adapted to cover the front edge of the sole of the shoe and a portion of said bottom element which is to lie in front of said front edge, said portion providing the location for an upstanding pin having a locking edge engageable with a retaining portion of said guard element adjacent thereto and said bottom member having a ramp-like shaped rib extending longitudinally of and projecting downwardly from its under side to a position adjacent said pin to space the bottom member from the ski beneath said pin.

2. The binding of claim 1, wherein said longitudinal sides of the guard element are shaped at one end so as to coincide with respective ears of said bottom member to present a substantially closed external surface therewith.

3. The binding of claim 1, wherein said guard element has a ski scraper-forming upper edge extending rectilinearly between said lateral side and said retaining portion thereof to divide said element into similar portions.

4. The binding of claim 1, wherein the lateral side of said guard element has a shape which curves away from the pivotal axis.

5. The binding of claim 1, wherein the guard element is mounted in a prestressed condition 10° – 20° away from its downward active position.

6. The binding of claim 1, wherein said ramp-like shaped rib has an ascending angle adapted to confer an upwards and forwards inclination on said shoe sole of from 1° –5°.

7. The binding of claim 6, wherein said inclination is between 2° and 3°.

8. A ski binding which comprises a bottom member for mounting on a a ski and for receiving a sole of a ski shoe, said member having ears adapted to project upwardly on either side of the toe of said shoe, a guard element having a continuous surface shaped essentially as a shoe toe and pivotably mounted on said ears to permit pivotal movement between upward inactive and downward active positions about an axis passing through said ears, said element having a lateral side and longitudinal sides converging forwardly from opposite ends of said lateral side, said lateral side facing said pivotal axis of said element and defining at its under edge clamp means designed in said upward position to permit insertion on said bottom member of said sole of said shoe at its toe and in said downward position to hold the edge of said shoe sole down against the bottom member with said longitudinal sides of said guard element reaching down adjacent said bottom member, means associated with at least one of said bottom member and said clamp means for retainingly engaging said sole, and said guard element when in said active position being adapted to cover the front edge of the sole of the shoe and a portion of said bottom element which is to lie in front of said front edge, said portion supporting fastening means adapted to engage a retaining portion of said guard element adjacent thereto, and said guard element having a ski scraper-forming upper edge extending rectilinearly between said lateral side and said retaining portion thereof to divide said element into similar portions.

9. The binding of claim 8, wherein the fastening means is an upstanding pin having a locking edge for engagement with said retaining portion and said bottom member having a rib extending longitudinally of and projecting downwardly from its under side in the shape of a ramp up to a position adjacent said upstanding pin to form a pin-locating portion of the bottom element spaced from the upper surface of said ski and adapted for flexing downwards.

* * * * *